US011440011B2

(12) United States Patent
Park et al.

(10) Patent No.: US 11,440,011 B2
(45) Date of Patent: Sep. 13, 2022

(54) MEDICAL TEST SLIDE UNIT

(71) Applicant: THE CATHOLIC UNIVERSITY OF KOREA INDUSTRY-ACADEMIC COOPERATION FOUNDATION, Seoul (KR)

(72) Inventors: Yeon Joon Park, Seoul (KR); Kang Gyun Park, Yongin-si (KR)

(73) Assignee: THE CATHOLIC UNIVERSITY OF KOREA INDUSTRY-ACADEMIC COOPERATION FOUNDATION, Seoul (KR)

( * ) Notice: Subject to any disclaimer, the term of this patent is extended or adjusted under 35 U.S.C. 154(b) by 288 days.

(21) Appl. No.: 16/493,095

(22) PCT Filed: Jan. 22, 2018

(86) PCT No.: PCT/KR2018/000925

§ 371 (c)(1),
(2) Date: Sep. 11, 2019

(87) PCT Pub. No.: WO2018/199435

PCT Pub. Date: Nov. 1, 2018

(65) Prior Publication Data

US 2020/0398272 A1 Dec. 24, 2020

(30) Foreign Application Priority Data

Apr. 25, 2017 (KR) ..... 10-2017-0052753

(51) Int. Cl.
*B01L 9/00* (2006.01)
*B01L 3/00* (2006.01)

(52) U.S. Cl.
CPC ..... *B01L 3/5085* (2013.01); *B01L 9/00* (2013.01); *B01L 9/52* (2013.01); *B01L 2200/02* (2013.01);
(Continued)

(58) Field of Classification Search
None
See application file for complete search history.

(56) References Cited

U.S. PATENT DOCUMENTS 2,262,058 A * 11/1941 Sinclair ..... B42F 19/00 40/649
2,633,980 A * 4/1953 Vesterdal ..... G02B 21/34 206/456
(Continued)

FOREIGN PATENT DOCUMENTS

CN 204287595 U 4/2015
CN 205844620 U 12/2016
(Continued)

*Primary Examiner* — Paul S Hyun
(74) *Attorney, Agent, or Firm* — Novick, Kim & Lee, PLLC; Sang Ho Lee; Hyun Woo Shin

(57) ABSTRACT

Provided is a medical test slide unit including a frame main body including: a marker part which has a thin plate shape and in which a plurality of position indicating markers are formed longitudinally and transversely; and a border part arranged to surround the marker part, wherein a step is formed between the border part and the marker part to form a seating recess, and wherein a slide, on which a specimen to be examined using a microscope is placed, is selectively seated in the seating recess.

8 Claims, 7 Drawing Sheets

(52) U.S. Cl.
CPC ..... *B01L 2200/04* (2013.01); *B01L 2200/141* (2013.01); *B01L 2300/0822* (2013.01); *B01L 2300/0887* (2013.01)

(56) References Cited

U.S. PATENT DOCUMENTS

| | | | | | |
|---|---|---|---|---|---|
| 3,746,161 | A * | 7/1973 | Jones | B01L 9/52 | 206/456 |
| 4,819,804 | A * | 4/1989 | Levy | B65D 85/48 | 206/456 |
| 4,981,805 | A | 1/1991 | Yazawa et al. | | |
| 2004/0001779 | A1 * | 1/2004 | Anderson | B01L 9/52 | 422/510 |
| 2005/0271557 | A1 * | 12/2005 | Lee | B01L 9/52 | 422/400 |

FOREIGN PATENT DOCUMENTS

| | | | | |
|---|---|---|---|---|
| JP | 3165429 | U | 1/2011 | |
| KR | 20-0253133 | Y1 | 11/2001 | |
| KR | 10-0704384 | B1 | 4/2007 | |
| WO | WO-0154814 | A2 * | 8/2001 | B01L 3/5027 |

* cited by examiner

MEDICAL TEST SLIDE UNIT

TECHNICAL FIELD

The present disclosure relates to a medical test slide unit, and more particularly, to a medical test slide unit having an improved structure in which an accurate position of a specimen is selectable to increase test precision, and a focus and a specimen position may be quickly determined during microscopic examination, and only a part thereof on which a specimen is placed is replaceable to reduce the costs of use.

BACKGROUND ART

In microscopic examination for examining cells or tissues, in general, a slide unit on which a specimen to be examined is placed is used.

Such slide units are manufactured in a thin glass panel shape on which a plurality of specimens are placed longitudinally and transversely. However, according to the slide units as above, positions at which the specimens are placed are inaccurate, and thus considerable time and effort are required to determine the positions of the specimens during microscopic examination. Also, the relative positions between the specimens are variable, and thus, contamination between neighboring specimens occurs frequently.

To address these problems, a slide unit in which a portion on which a specimen is placed is marked in a different color from that of other portions to allow identification of positions at which specimens are placed has been developed. However, such a slide unit involves problems in that a process of forming a position identifier by surface-treating a glass is required, and thus a relatively expensive product has to be disposed after just a single use, and that the relative positions between specimens are not actively modifiable, and thus, it is difficult to provide a suitable examination environment.

DESCRIPTION OF EMBODIMENTS

Technical Problem

Provided is a medical test slide unit for increasing precision and efficiency of specimen tests and reducing the costs of use and providing an environment suitable for tests.

Solution to Problem

According to an aspect of the present disclosure, a medical test slide unit includes: a frame main body including: a marker part which has a thin plate shape and in which a plurality of position indicating markers are formed longitudinally and transversely; and a border part arranged to surround the marker part, wherein a step is formed between the border part and the marker part to form a seating recess, and wherein a slide, on which a specimen to be examined using a microscope is placed, is selectively seated in the seating recess.

The slide may be selectively located in the seating recess of the frame main body to be attachably or detachably coupled to or from the frame main body, and a specimen to be examined using a microscope may be placed in a position corresponding to the position indicating marker.

The marker part of the frame main body may further include, in addition to the position indicating markers, a guide marker allowing identifying a position or a focus of the microscope.

The position indicating markers and the guide marker of the marker part may be each formed in a shape of through holes.

The marker part may include an exposure recess that is not overlapped by the slide while the marker part and the slide are stacked on each other, to facilitate easy separation of the slide seated in the seating recess, from the frame main body.

The border part of the frame main body may include a cut recess through which the exterior of the border part is communicated with the exposure recess.

The border part may further include a rail groove guiding movement of the marker part to facilitate coupling and separation with respect to the marker part.

Advantageous Effects of Disclosure

The medical test slide unit having the above-described configuration is configured by separately manufacturing the frame main body, which is a component enabling identification of positions on which specimens are to be placed, and the slide, which is a component on which the specimens are actually placed, and then coupling these components. Accordingly, specimens may be accurately and quickly placed on required positions, and the medical test slide unit may be used just by replacing the slide, on which the specimens are placed.

Thus, according to the present disclosure with the above-described advantages, contamination among specimens may be suppressed, thus increasing test precision. Also, as the positions of specimens may be easily identified, test efficiency may be increased. The frame main body may be reused or replaced according to necessity, thus reducing the costs of use. Moreover, an optimal environment required for tests may be provided through, for example, modification of relative positions between specimens in various manners (diversification of the standard of the frame main body).

BEST MODE

Hereinafter, a medical test slide unit according to an embodiment of the present disclosure will be described in detail with reference to the attached drawings.

Figure 1:
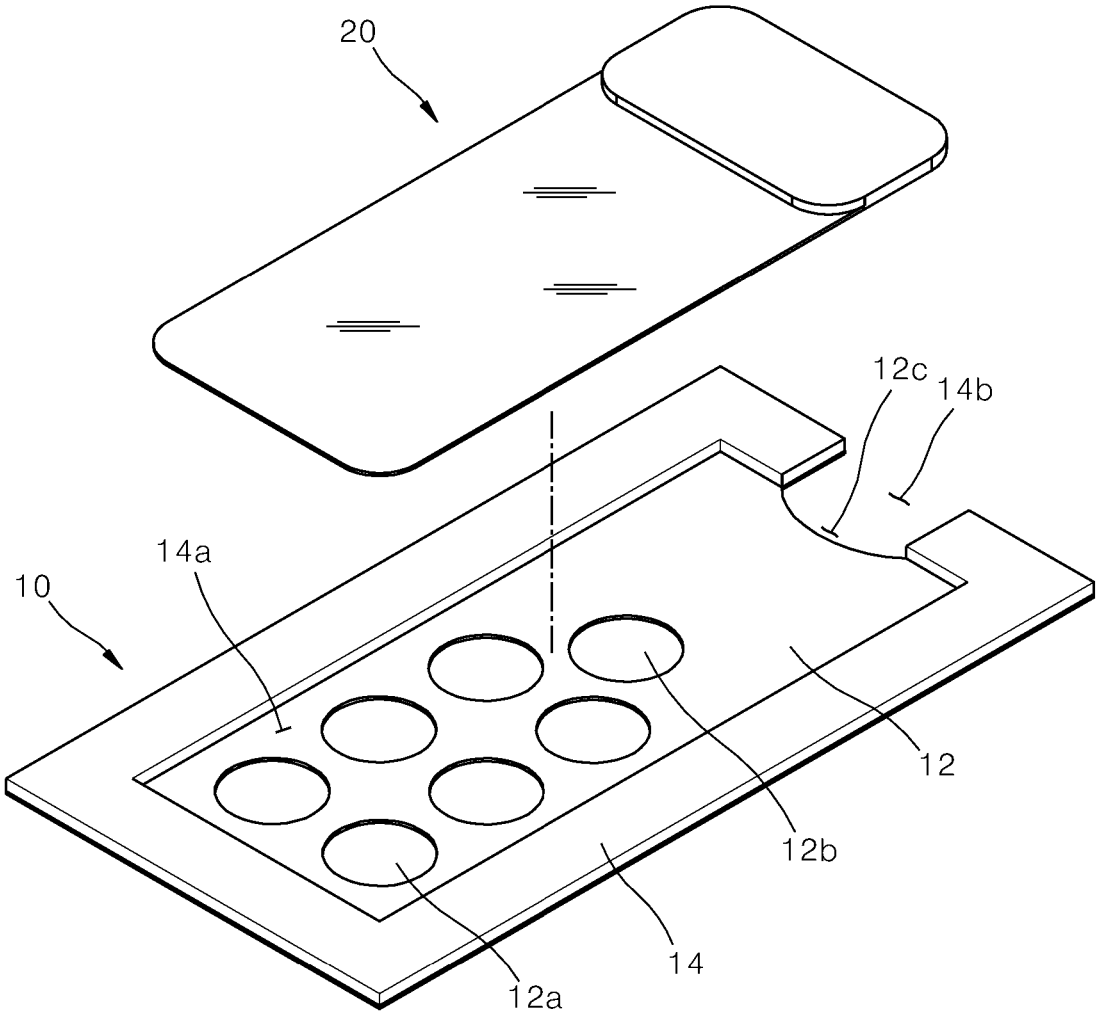
FIG. 1 is an exploded perspective view of a medical test slide unit according to an embodiment of the present disclosure.
Figure 2:
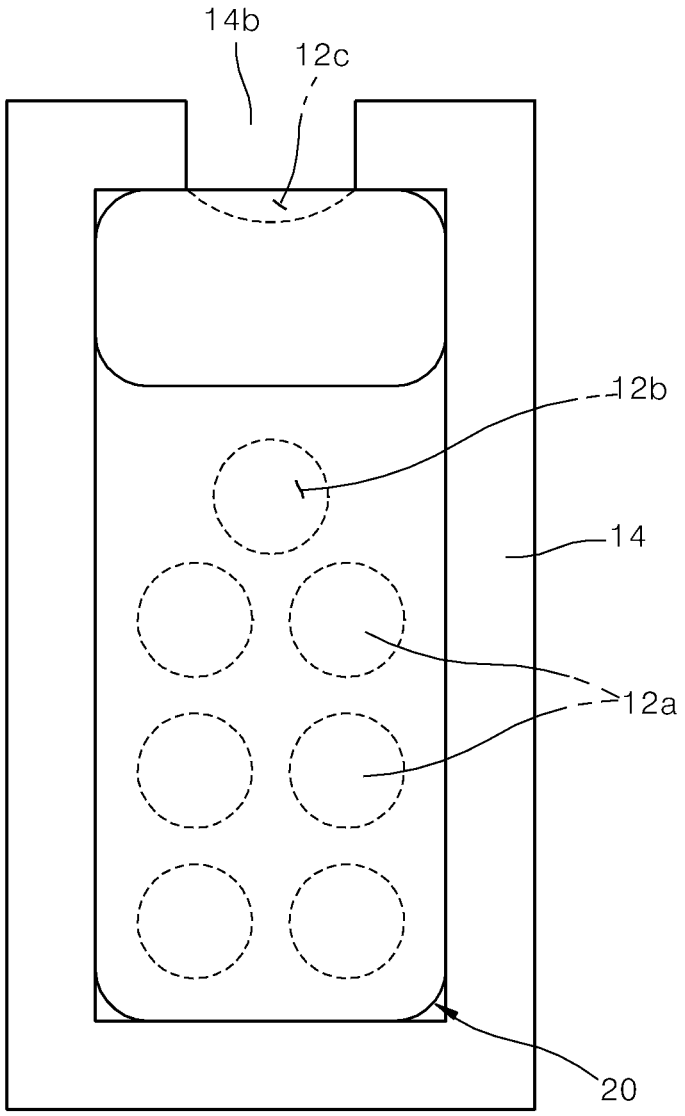
FIG. 2 is a plan view of a coupled state, according to an embodiment of the present disclosure.
Figure 3:
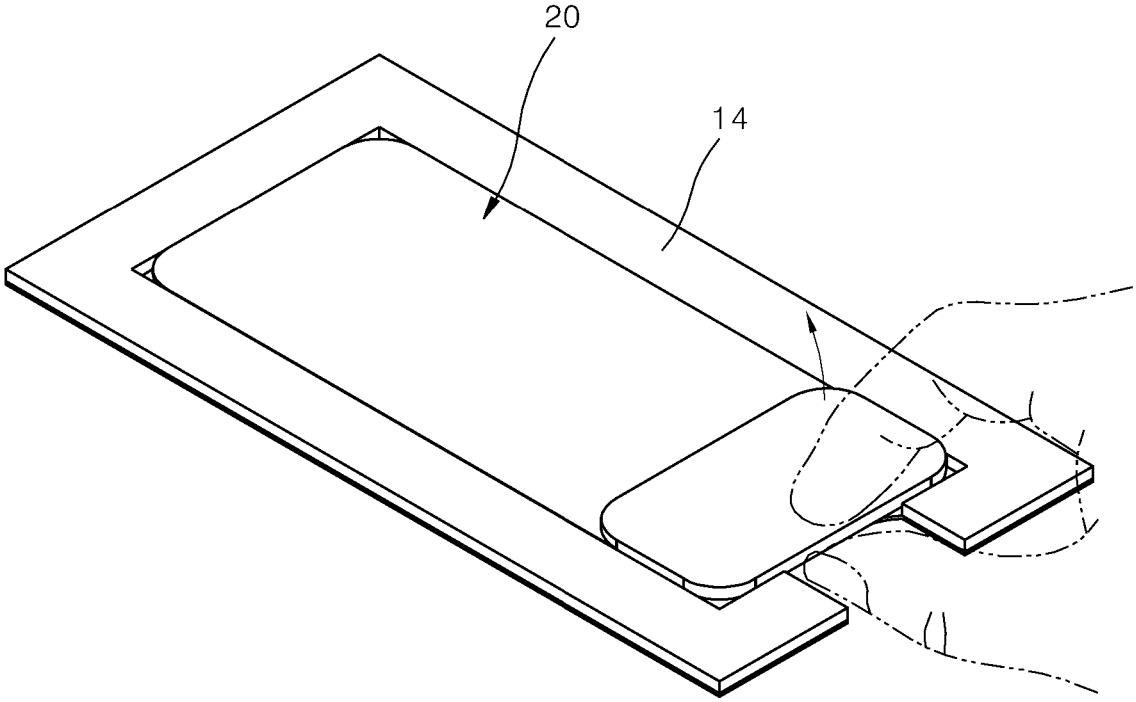
FIG. 3 is a perspective view of a coupled state, according to an embodiment of the present disclosure.

FIG. 1 is an exploded perspective view of a medical test slide unit according to an embodiment of the present disclosure. FIG. 2 is a plan view of a coupled state, according to an embodiment of the present disclosure. FIG. 3 is a perspective view of a coupled state, according to an embodiment of the present disclosure.

As illustrated in the drawings, the medical test slide unit according to an embodiment of the present disclosure is to test a specimen such as urine or cells by using a microscope, and includes a frame main body 10 and a slide 20.

The frame main body 10 is provided to facilitate identification of positions of specimens placed on the slide 20 and includes a marker part 12 having a thin plate shape and a border part 14 arranged to surround the marker part 12.

The marker part 12 may be implemented in any shape or structure capable of allowing easy identification of positions of specimens. However, in the present embodiment, a plurality of position indicating markers 12*a* are arranged longitudinally and transversely at uniform intervals.

As the border part 14 is formed with a step with respect to the marker part 12 as thoroughly illustrated in FIG. 1, a seating recess 14*a* into which the slide 20 is to be seated is formed.

The marker part 12 and the border part 14 may be formed as a single body by using a single material, or may also be separately manufactured and then coupled to each other by adhesion or the like.

The slide 20 is formed of a light-transmissive material such as glass such that a light source of a microscope may transmit therethrough. The slide 20 may be selectively located in the seating recess 14*a* of the frame main body 10 to be attachably or detachably coupled to or from the frame main body 10. While being seated in the seating recess 14*a* of the frame main body 10 as illustrated in FIG. 2, the slide 20 allows a specimen to be placed on a portion thereof corresponding to the position indicating markers 12*a* denoted by a dotted line.

As described above, a microscopic test is performed while the specimen is placed on an upper surface of the slide 20, and after the test is completed, as illustrated by an alternate long and two short dashes line of FIG. 3, a portion of the slide 20 may be gripped with the finger and lifted up, thereby separating the slide 20 from the frame main body 10.

The slide 20 may preferably have a structure in which a portion thereof on which a specimen is placed and a finger-gripping portion are distinguished from each other.

The medical test slide unit according to an embodiment of the present disclosure having the above-described configuration is configured by separately manufacturing the frame main body 10, which is a component enabling identification of positions on which specimens are to be placed, and the slide 20, which is a component on which the specimens are actually placed, and then coupling these components. Accordingly, specimens may be accurately and quickly placed on required positions, and the medical test slide unit may be used just by replacing the slide 20, on which the specimens are placed.

Thus, according to the present disclosure with the above-described advantages, contamination among specimens may be suppressed, thus increasing test precision. Also, as the positions of specimens may be easily identified, test efficiency may be increased. The frame main body 10 may be reused or replaced according to necessity, thus reducing the costs of use.

Moreover, an optimal environment required for tests may be provided through, for example, modification of relative positions between specimens in various manners (diversification of the standard of the frame main body 10).

Meanwhile, the marker part 12 of the frame main body 10 further includes, in addition to the position indicating markers 12*a*, a guide marker 12*b* allowing identifying a position or a focus of the microscope. Thus, formation of an optimal focus for tests and identification of relative positions of specimens with respect to the microscope may be facilitated and thus test precision and efficiency may be further increased.

Also, the position indicating markers 12*a* and the guide marker 12*b* of the marker part 12 may have any shape or structure as long as functions such as identification of specimen positions and formation of a focus of a microscope are derived. However, for reasons such as convenience of the manufacture, the position indicating markers 12*a* and the guide marker 12*b* may preferably be formed in a shape of through holes.

The marker part 12 employed in the present embodiment also includes an exposure recess 12*c* as illustrated by a dotted line in FIG. 2, wherein the exposure recess 12*c* is not overlapped by the slide 20 while the marker part 12 and the slide 20 are stacked on each other. Thus, as shown in FIG. 3, a user may grip the slide 20 more easily.

The border part 14 employed in the present embodiment may preferably include a cut recess 14*b* through which the exterior of the border part 14 is communicated with the exposure recess 12*c* such that the slide 20 is easily separated from the frame main body 10 together with the exposure recess 12*c* of the marker part 12.

Hereinafter, a medical test slide unit according to another embodiment of the present disclosure will be described with reference to FIGS. 4 and 5.

Figure 4:
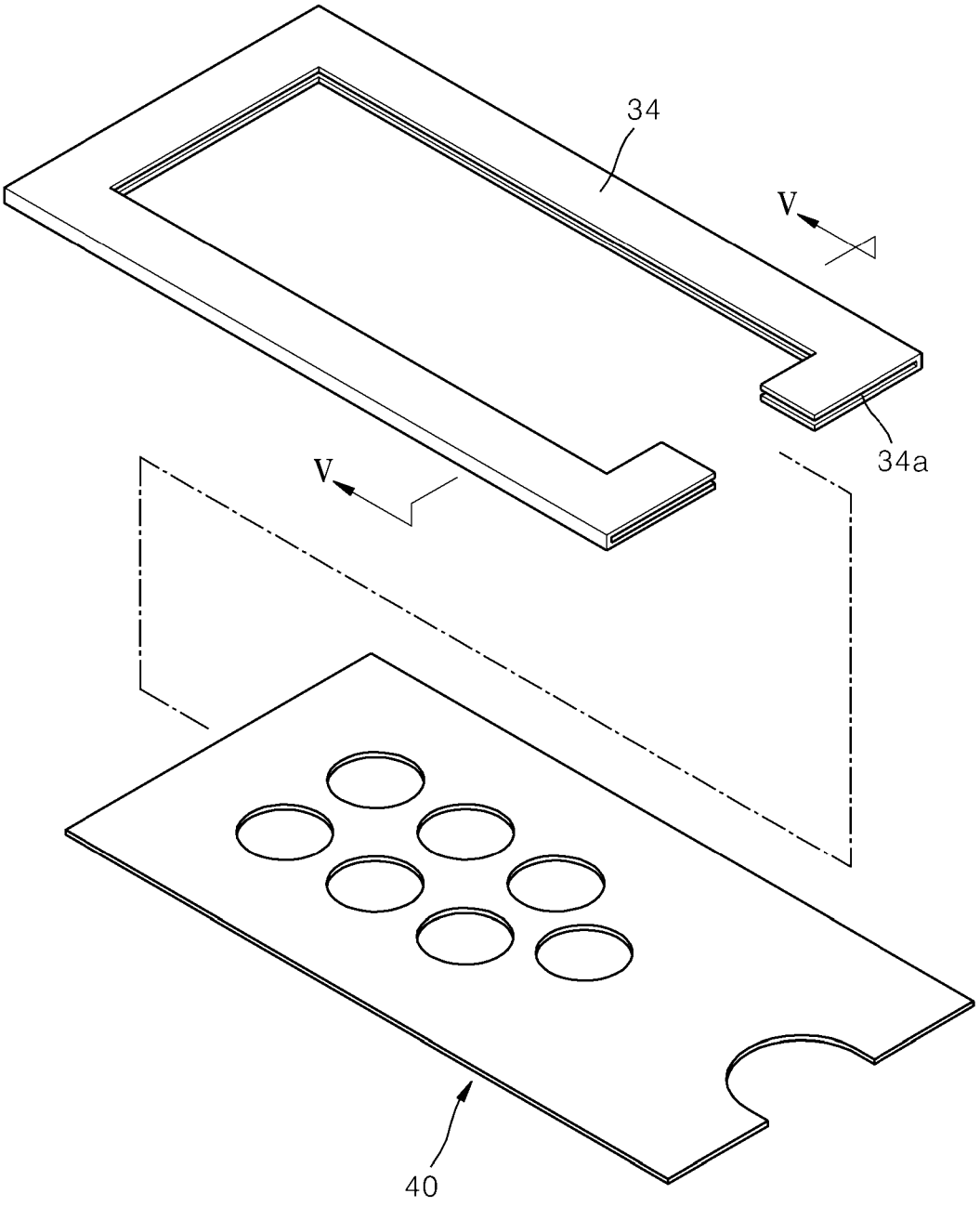
FIG. 4 is an exploded perspective view of a frame main body employed according to another embodiment of the present disclosure.

FIG. 4 is an exploded perspective view of a frame main body employed according to another embodiment of the present disclosure. FIG. 5 is a cross-sectional view of a frame main body employed in another embodiment of the present disclosure and in a coupled state, cut long V-V of FIG. 4.

As illustrated in these drawings, the frame main body employed in the present embodiment includes a border part 34 in which a rail groove 34*a* is formed.

That is, the border part 34 includes the rail groove 34*a* guiding movement of a marker part (40) such that coupling and separation with respect to the marker part 40 are easily performed.

According to the present embodiment having the above-described configuration, as the coupling and separation between the marker part 40 and the border part 34 by using the rail groove 34*a* of the border part 34 are enabled, the marker part 40 in which position indicating markers of different standards may be easily replaced and used, thus allowing expectation of the advantage of providing an optimal environment suitable for specimen tests.

Figure 6:
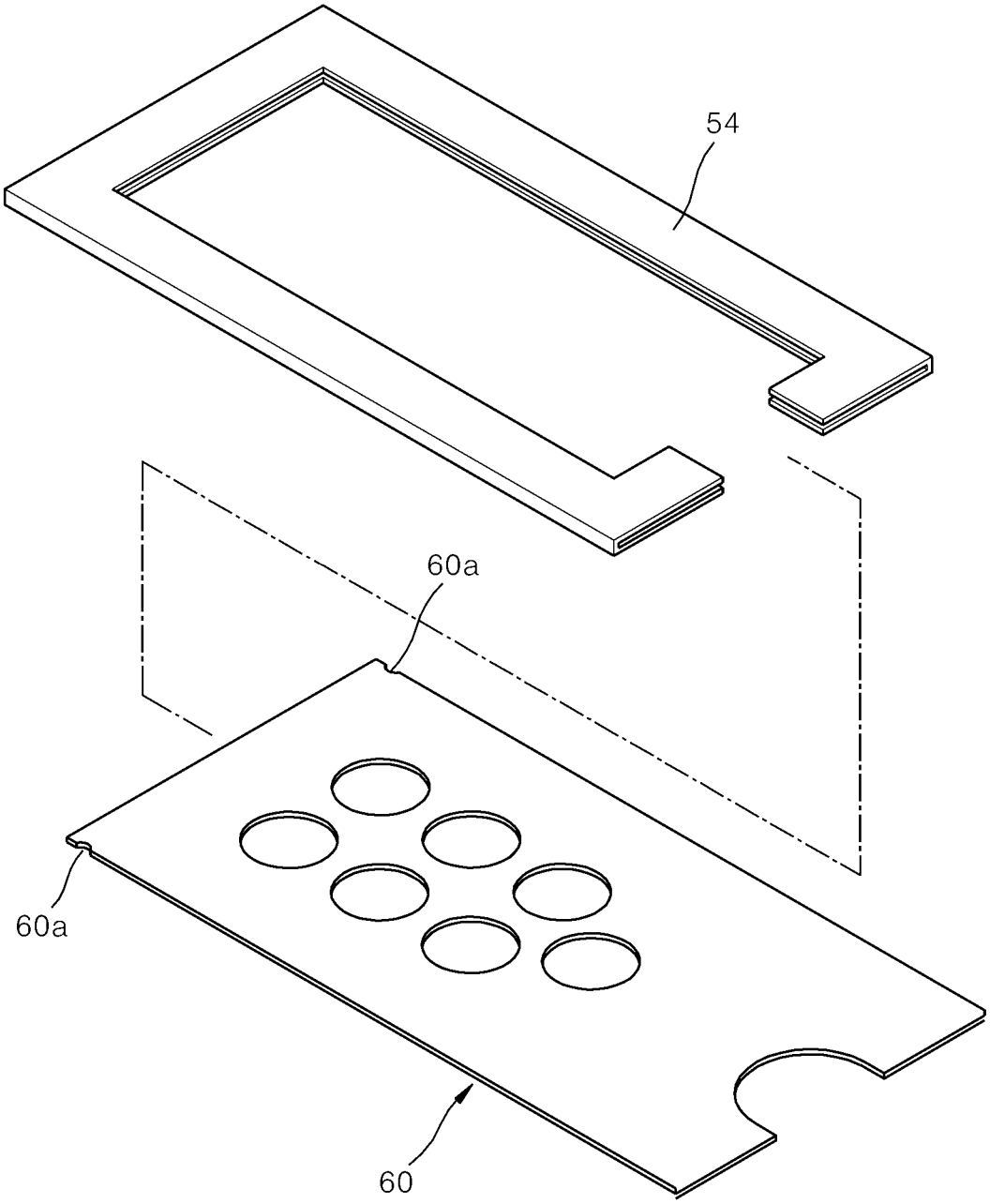
FIG. 6 is an exploded perspective view of a frame main body employed according to another embodiment of the present disclosure.
Figure 7:
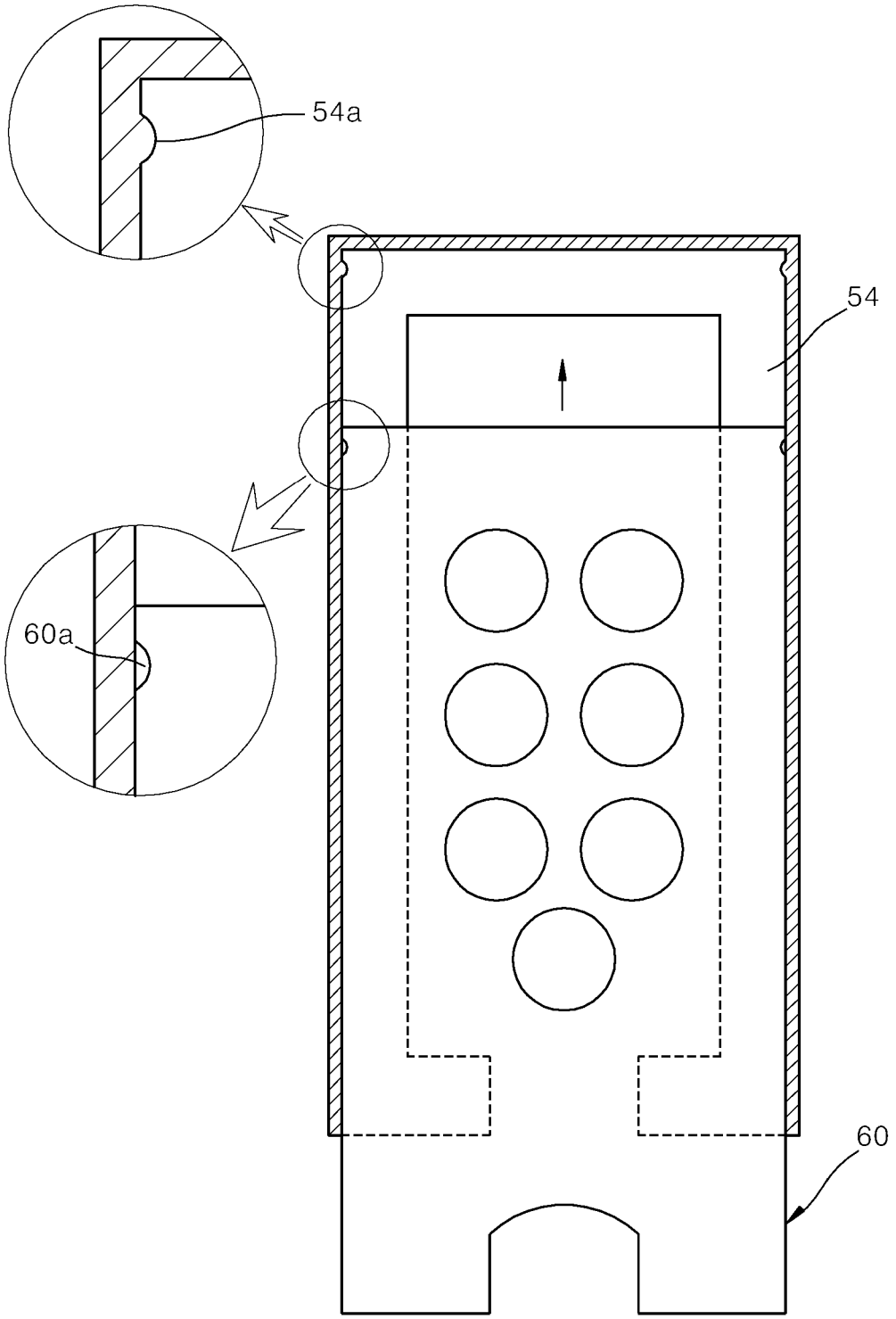
FIG. 7 is a partial sectional plan view for describing a coupling process of a frame main body employed in another embodiment of the present disclosure.

FIG. 6 is an exploded perspective view of a frame main body employed according to another embodiment of the present disclosure. FIG. 7 is a partial sectional plan view for describing a coupling process of a frame main body employed in another embodiment of the present disclosure.

Figure 5:
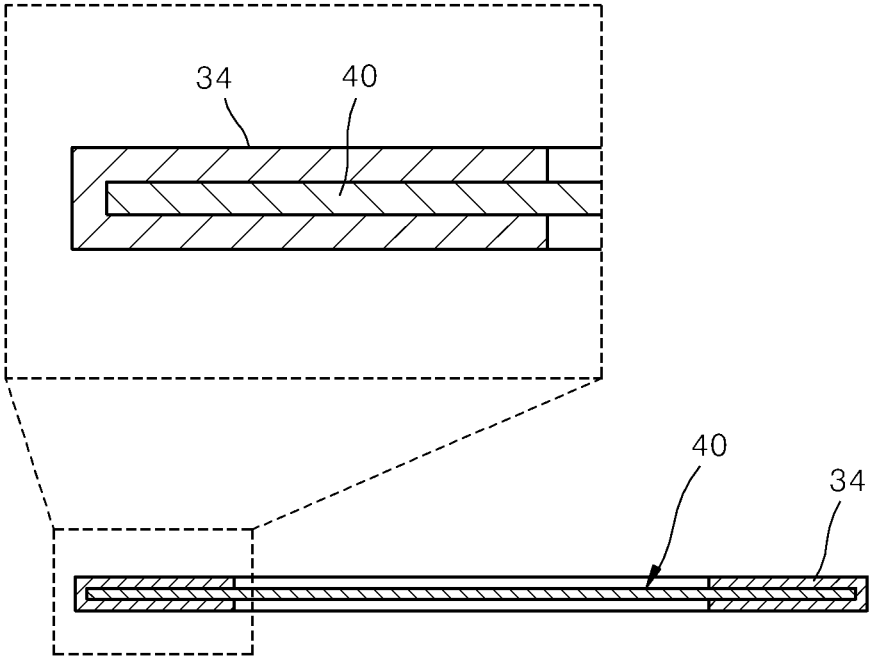
FIG. 5 is a cross-sectional view of a frame main body employed in another embodiment of the present disclosure and in a coupled state, cut long V-V of FIG. 4.

As illustrated in the drawings, a border part 54 employed in the frame main body of the present embodiment is similar to the embodiment illustrated in FIGS. 4 and 5 in that the border part 54 includes a rail groove to and from which a marker part 60 is coupled and separated by sliding. However, there is a difference in that a pair of catching protrusions 54*a* are formed on a surface defining the rail groove, and a pair of catching grooves 60*a* which are caught selectively by the catching protrusions 54*a* are formed in the marker part 60.

According to the present embodiment of the above-described configuration, a remarkably greater coupling force of the marker part 60, in which position indicating markers of various standards are formed, may be ensured with respect to the border part 54, and thus, test precision and efficiency may be further increased.

While one or more embodiments of the present disclosure have been described with reference to the figures, the present embodiments and the drawings attached in the present specification merely illustrate part of the concept included in the present disclosure, and modified examples and specific embodiments that are easily derivable by one of ordinary skill in the art within the scope of the concept included in the specification and the drawings of the present disclosure are construed as being obviously included in the scope of the present disclosure.

The invention claimed is:

1. A medical test slide unit comprising a frame main body, wherein the frame main body comprises:

a marker part having a thin plate shape and comprising a plurality of position indicating markers formed longitudinally and transversely; and a border part surrounding the marker part, wherein a step is formed between the border part and the marker part to form a seating recess, wherein the seating recess is configured to seat therein a slide, on which a specimen to be examined using a microscope is located, wherein the border part comprises a rail groove for facilitating coupling and separation of the border part and the marker part by guiding movement of the marker part, and wherein the slide is selectively located in the seating recess of the frame main body to be attachably or detachably coupled to or from the frame main body, and the specimen to be examined using the microscope is located in a position corresponding to one or more of the plurality of position indicating markers.

2. The medical test slide unit of claim 1, wherein the marker part of the frame main body further comprises, in addition to the plurality of position indicating markers, a guide marker for identifying a position or a focus of the microscope.

3. The medical test slide unit of claim 2, wherein the position indicating markers and the guide marker of the marker part are each formed as through holes.

4. The medical test slide unit of claim 2, wherein the guide marker of the marker part is formed as a through hole.

5. The medical test slide unit of claim 3, wherein the marker part comprises an exposure recess that is not overlapped by the slide when the marker part and the slide are stacked on each other, and the exposure recess facilitates separation of the slide seated in the seating recess from the frame main body.

6. The medical test slide unit of claim 5, wherein the border part of the frame main body further comprises a cut recess through which an exterior of the border part communicates with the exposure recess.

7. The medical test slide unit of claim 1, wherein each of the plurality of position indicating markers is formed as a through hole.

8. A medical test slide unit comprising a frame main body, wherein the frame main body comprises:

a marker part having a thin plate shape and comprising a plurality of position indicating markers formed longitudinally and transversely;

a border part surrounding the marker part, wherein a step is formed between the border part and the marker part to form a seating recess; and a slide comprising a specimen to be examined using a microscope, wherein the slide is selectively situated in the seating recess, wherein the border part comprises a rail groove for facilitating coupling and separation of the border part and the marker part by guiding movement of the marker part.

* * * * *